US006926059B2

(12) United States Patent
Somers et al.

(10) Patent No.: US 6,926,059 B2
(45) **Date of Patent: *Aug. 9, 2005**

(54) MASKING TAPE APPLICATOR

(75) Inventors: Micah T. Somers, Minneapolis, MN (US); Nathaniel R. Hallee, Minneapolis, MN (US); James F. Pitzen, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/748,567

(22) Filed: Dec. 30, 2003

(65) Prior Publication Data

US 2005/0145343 A1 Jul. 7, 2005

(51) Int. Cl.[7] ..... B44C 7/04
(52) U.S. Cl. ..... 156/577; 156/579
(58) Field of Search ..... 156/71, 523, 527, 156/574, 577, 579

(56) References Cited

U.S. PATENT DOCUMENTS

| | | | | |
|---|---|---|---|---|
| 2,891,691 | A | 6/1959 | Burger | |
| 2,953,274 | A | 9/1960 | Bertschinger | |
| 3,156,603 | A | 11/1964 | Robinson | |
| 3,740,297 | A | 6/1973 | Vidinsky | |
| 5,269,871 | A | 12/1993 | Longworth et al. | |
| 5,462,633 | A | 10/1995 | Manusch et al. | |
| 6,302,177 | B1 | 10/2001 | Gruber | |
| 6,742,562 | B2 * | 6/2004 | Pitzen | 156/577 |
| 2003/0234083 | A1 | 12/2003 | Pitzen | |

* cited by examiner

*Primary Examiner*—James Sells
(74) *Attorney, Agent, or Firm*—William L. Huebsch

(57) ABSTRACT

A device for applying tape from a roll of tape (e.g., masking tape) along a surface to be protected with an edge of the tape extending along a juncture between the surface to be protected and a surface to be treated disposed at about a right angle with respect to the surface to be protected. The device includes a two portion housing around and journaling the tape roll, each portion having a tape contacting part of its inner surface in a first plane, and having in a second plane a guide part of its outer surface adapted to be slid along the surface to be treated. The first and second planes on each of the housing portions can be parallel or at a small angle with respect to each other so that they intersect along an application side of the housing. A pressure application structure is mounted on the housing with an outer edge each end of the pressure application structure at the intersection (if they intersect) of the first and second planes for a different adjacent one of the housing portions. The pressure application structure is mounted on the housing for limited pivotal movement in a plane at about a right angle with respect to a plane along the guide surface. The roll of tape can be mounted in the housing for free rotation and axial movement. Tape from the roll extends around the periphery of the pressure application structure so that the dispenser can be manually positioned with either housing portion against the surface to be treated and moved to apply the tape, whereupon pressures applied to the tape being dispensed by the pressure application structure in the device will cause the side surface of the roll of tape to move toward or into contact with the tape contact part of the inner surface of the housing portion being slid along the surface to be treated so that the tape is accurately applied.

20 Claims, 5 Drawing Sheets

MASKING TAPE APPLICATOR

FIELD OF THE INVENTION

The present invention relates to devices for applying tape from a roll of tape (e.g., masking tape) along a surface to be protected with an edge of the tape extending along a juncture between the surface to be protected and a surface to be treated (e.g., painted) that is disposed at about a right angle with respect to the surface to be protected.

BACKGROUND OF THE INVENTION

Many devices have been designed for use to apply tape from a roll of tape (e.g., masking tape) along a surface to be protected with an edge of the tape extending along a juncture between the surface to be protected (e.g., a door or window molding) and a surface to be treated (e.g., a wall to be painted) that is disposed at about a right angle with respect to the surface to be protected. U.S. Pat. No. 5,269,871 (Longworth et al.) and U.S. Pat. No. 6,302,177 (Gruber) provide illustrative examples. While such prior art devices can be useful for this purpose, all such known prior art devices either are too expensive for use by most homeowners or the like, do not apply the tape at the exact location or with the accuracy that is desired, and/or lack versatility in that the tape can not be applied while moving the device in either of two directions along the surface to be protected without repositioning the roll of tape in the device.

U.S. Pat. No. 6,742,562 (Pitzen) (the content whereof is incorporated herein by reference) describes a device for applying tape from a roll of tape (e.g., masking tape) along a surface to be protected with an edge of the tape extending along a juncture between the surface to be protected and a surface to be treated. That device is sufficiently inexpensive that it can be used by most homeowners or the like, applies the tape at a desired location with great accuracy, and can provide versatility in that the tape can be applied while moving the device in either of two directions along the surface to be protected without repositioning the roll of tape in the device. That device includes a housing around a roll of tape comprising two housing side portions, each housing side portion having a tape contact part of an inner surface for the housing side portion in a first plane along which a side of the tape wound around the core is positioned, and having in a second plane a guide part of an outer surface for the housing side portion, which guide part of the outer surface is adapted to be slid along the surface to be treated. The first and second planes on each of the housing side portions can be at a small angle with respect to each other (i.e., in the range of about 1 to 4 degrees such as about 1.5 degrees) and disposed to intersect along an application side of the housing. The device also includes a pressure application structure having opposite end portions (e.g., each end portion can comprise a pressure roller), which pressure application structure has a peripheral surface that is arcuate (e.g., generally cylindrical about an axis when pressure rollers are used), and has outer edges at the ends of its peripheral surface. The pressure application structure is mounted on the housing with the peripheral surfaces of end portions of the pressure application structure generally in alignment, with a part of the peripheral surface of each of the end portions at or closely adjacent to its outer edge at the intersection of the first and second planes for a different adjacent one of the side portions of the housing, and with the arcuate peripheral surface of the end portion of the pressure application structure disposed at an angle of no greater than 90 degrees with respect to the adjacent second plane (i.e., disposed at an angle in the range of about 80 to 90 degrees such as 87.5 degrees with respect to that second plane) and projecting from the housing at the intersection of the first and second planes. Means are provided for attaching the side portions of the housing together and for journaling the roll of tape between the side portions of the housing with the tape contact part of the inner surface for each housing portion along a different one of side surfaces of the wound length of tape included in the roll of tape. Means are also provided for defining a path for the length of tape from the periphery of the roll of tape to the periphery of the pressure application structure with the edges of the tape at or adjacent the intersections of the first and second planes and with adhesive included in the tape on the side of a backing included in the tape opposite the pressure application structure so that the dispenser can be manually positioned with either portion of the housing against the surface to be treated and moved along the surfaces to be treated and protected to accurately apply and press the tape from the roll of tape on the surface to be protected with the peripheral surface of the pressure application structure and with one edge of the tape at a predetermined relationship with respect to the juncture between the surface to be protected and the surface to be treated. Each end portion of the pressure application structure can have an end surface projecting in the range of about 0.005 to 0.02 inch or 0.01 to 0.05 centimeter beyond the intersection of the first and second planes. That end surface can move along a surface to be treated and provide a predetermined small spacing along the surface to be protected between the surface to be treated and the adjacent edge of the tape being applied to the surface to be protected. That space is useful to insure that the surface to be treated is fully treated (e.g., if the surface to be treated is a wall being painted, the thickness of the edge of the tape will not prevent the paint from extending along the wall to the intersection between the wall and the surface to be protected).

While the device described in U.S. Pat. No. 6,742,562 can accurately apply tape, it requires providing a close tolerance between the tape contact parts of the inner surfaces of the housing portions and die side surfaces of the roll of tape to be applied by the device. A wide variance normally occurs during production in widths of different rolls of tape of the same nominal width (e.g., plus or minus 0.06 inch or 0.15 cm). This means that when the device is being produced either the device is produced with the tape contact parts of the inner surfaces for the housing side portions at a predetermined spacing and rolls of tape for use in the device must be selected from production rolls that have widths in a close tolerance range, or means must be provided for attaching the portions of the housing together that can provide a close tolerance between the tape contact parts of the inner surfaces of the housing portions and the side surfaces of a roll of tape placed in it despite those variances in the widths of various production rolls of tape, either of which approaches can add cost to the structure and/or assembly of the device.

DISCLOSURE OF THE INVENTION

The present invention provides a device for applying tape from a roll of tape (e.g., masking tape) along a surface to be protected with an edge of the tape extending along a juncture between the surface to be protected and a surface to be treated that is disposed at about a right angle with respect to the surface to be protected, which device has some structure that is similar to the structure of the device described in U.S.

Pat. No. 6,742,562, but includes a novel pressure application structure that can apply the tape at exact desired locations with great accuracy, and can apply the tape while moving the device in either of two directions along the surface to be protected, but does not require providing as close a tolerance between tape contact parts of inner surfaces for housing side portions and a roll of tape to be applied by the device, thereby better accommodating the wide variance in widths of different production rolls of tape of the same nominal width.

The device according to the present invention comprises a housing adapted to receive the roll of tape, which housing has a guide surface adapted to be slid along the surface to be protected and comprises at least one and preferably two housing portions, each of which housing portions has a tape contact part of an inner surface for the housing portion in a first plane, and has in a second plane a guide part of an outer surface for the housing portion adapted to be slid along the surface to be treated. The first and second planes on each of the housing portions are disposed relative to each other in a range between being parallel to each other and being disposed at a small angle (e.g., less than 4 degrees such as 2 degrees) with respect to each other with the first and second planes intersecting adjacent the intersection of the second plane and a plane along the guide surface. The device also includes a pressure application structure having opposite end portions, each of which end portions has an arcuate peripheral surface around an axis, and an outer edge. The pressure application structure is mounted on the housing for a limited predetermined amount of pivotal movement (e.g., about ½ to 4 degrees, such as 2 degrees) in either direction away from a position with the axes of the arcuate peripheral surfaces at a right angle with respect to the first planes on the housing portions, that pivotal movement being about a pivot axis midway between the end portions, transverse to the axis of the peripheral surfaces, and in a plane at about a right angle with respect to a plane along the guide surface. The arcuate peripheral surface on each end portion of the pressure application structure is disposed at an angle of no greater than 90 degrees (e.g., at about 89.5 degrees) with respect to the adjacent second plane and projects from the housing when the pressure application structure is pivoted to its that maximum angle to move that end portion of the pressure application structure toward a top side of the housing portion opposite the guide surface. Means are provided for attaching the portions of the housing together as well as means for journaling the roll of tape for free rotation and axial movement between the portions of the housing with the tape contact part of the inner surface for each housing portion along a different one of the side surfaces of the roll of tape; and means are also provided for defining a path for the length of tape from the periphery of the roll of tape to the periphery of the pressure application structure with the adhesive on the tape on the side of the backing opposite the pressure application structure so that the dispenser can be manually positioned with either portion of the housing against the surface to be treated and moved along the surfaces to be treated and protected to accurately apply and press the tape from the roll of tape on the surface to be protected with one of the peripheral surfaces of the pressure application structure and with the edge of the tape at a predetermined relationship with respect to the juncture between the surface to be protected and the surface to be treated.

The pressure application structure can include an axle having a generally cylindrical slightly tapered roller fixed at each of the opposite ends of the axle to provide the arcuate peripheral surfaces, with means being provided for mounting the center of the axle on the housing for both limited pivotal motion of the axle about the pivot axis and for rotation of said axle and rollers about the axis of the rollers.

Alternatively, the pressure application structure can include an axle, and a generally cylindrical slightly tapered roller mounted for rotation on each of the opposite ends of the axle to provide the arcuate peripheral surfaces, with means being provided for mounting the center of the axle on the housing to allow limited pivotal motion of the axle about the pivot axis.

This structure has been found to apply the tape at exact desired locations with great accuracy, and can apply the tape while moving the device in either of two directions along the surface to be protected, while only requiring a tolerance of about 0.06 inch or 0.15 cm between the inner surfaces of the housing portions and a roll of tape to be applied by the device. This tolerance can be allowed because pressure applied to the tape being dispensed by the end portions of the pressure application structure in the device will cause the side surface of the roll of tape to move toward or into contact with the tape contact part of the inner surface of the housing portion being slid along the surface to be treated.

A modified version of the above described device can also be made in which the means for journaling the roll of tape still affords free rotation of the roll of tape, but does not allow free axial movement of the roll of tape between the portions of the housing. In this modified version a user of the device must manually move the roll of tape into contact with the tape contact part of the inner surface for the housing portion that is being moved along a surface to apply the tape, however, this modified device provides the advantage that it can be used to apply rolls of tape that have an axial width dimension that is significantly less than the dimension between the tape contact parts of the inner surfaces for the housing portions. Thus, the same dispenser can be used to accurately apply tapes of different widths.

DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
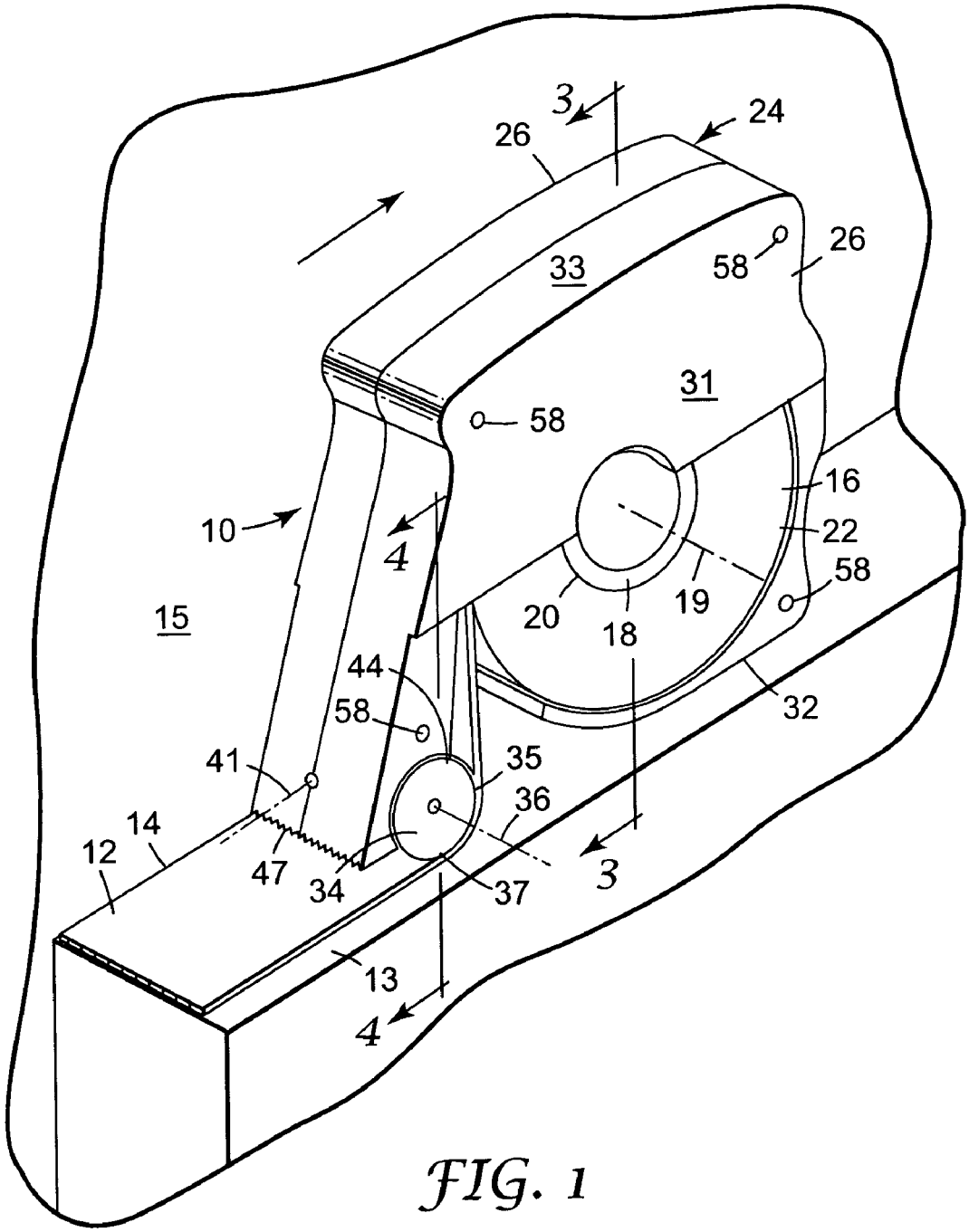
FIG. 1 is a perspective view of a first embodiment of a device according to the present invention being used to apply tape from a roll of tape along a surface to be protected with an edge of the tape extending along a juncture between the surface to be protected and a surface to be treated that is disposed at about a right angle with respect to the surface to be protected.

Referring now to FIGS. 1 through 4 of the drawing there is illustrated a first embodiment of a device 10 according to the present invention that can be manually used to apply a length of tape 12 along a surface 13 to be protected (e.g., the side surface 13 of a window or door molding) with an edge 14 of the tape 12 extending along a juncture between the surface 13 to be protected and a surface 15 to be treated (e.g., a wall 15 to be painted) disposed at about a right angle with respect to the surface 13 to be protected.

The device 10 includes or is adapted to receive a roll 16 of tape (e.g., masking tape of the type commercially available from 3M Company, St. Paul, Minn., that may nominally be ½, ¾, or 2 inches or 1.3, 1.9, 2.5, or 5 centimeters wide) including a core 18 having an axis 19, a cylindrical periphery 20 around the axis 19, and including a length of the tape 12 (e.g., masking tape) that comprises a backing having opposite major surfaces extending between opposite elongate edges and a layer of pressure sensitive adhesive along one of the major surfaces. The length of tape 12 is wound around the periphery 20 of the core 18 with the edges of the wound tape 12 aligned to form generally planer side surfaces 22 for the roll 16 of tape.

The device 10 includes a housing 24 around the roll 16 of tape. The housing 24 comprises two alocirol housing portions 26 molded of a polymeric material (e.g., polystyrene, ABS, or polypropylene), each of which housing portions 26 has a tape contact part 28 of an inner surface for the housing portion 26 in a first plane 29 (See FIG. 3), which tape contact part 28 is adapted to lay along one of the side surfaces 22 for the roll 16 of tape. Each housing portion 26 also has in a second plane 30 a guide part 31 of an outer surface for the housing portion 26 that is adapted to manually be slid along the surface 15 to be treated. The first and second planes 29 and 30 on each of the housing portions 26 could be disposed parallel to each other, but preferably, as illustrated, are disposed at a small angle with respect to each other (i.e., at an angle in the range of about 1 to 4 degrees with respect to each other, such as at an angle of about 2 degrees with respect to each other) and are disposed to intersect along a side of the housing 24 that has a guide surface 32 adapted to be manually slid along the surface 13 to be protected as the guide part 31 is being slid along the surface 15 to be treated by a user who can manually grasp the housing 24 around its top side 33 opposite the guide surface 32.

The device 10 also includes a pressure application structure having opposite end portions each comprising a pressure roller 34. Each pressure roller 34 has a peripheral surface 35 that is generally arcuate or cylindrical about an axis 36 common to the rollers 34, and has an outer edge 37 at one end of the peripheral surface 35. The pressure rollers 34 are mounted on the housing 24 for rotation about their common axis 36, with the peripheral surfaces 35 of the pressure rollers 34 generally in alignment. The pressure rollers 34 are also mounted on the housing 24 for pivotal movement about a pivot axis 41 along and transverse to the axis 36 of the rollers 34 midway between the rollers 34. That pivotal movement is preferably only in a plane at about a right angle with respect to a plane along the guide surface 32 and is limited to movement over a small pivot angle (i.e., in the range of plus or minus ½ to 4 degrees or preferably about plus or minus about 2 degrees) with respect to a central position with the axis 36 at a right angle with respect to the tape contact parts 28 of the inner surfaces for the housing portions 26. The rollers 34 are positioned so that a plane along the guide surface 32 on the housing 24 will about intersect the outer edge 37 along its side opposite the top side 33 of the housing 24 of either one of the rollers 34 that is moved its maximum distance toward the top side 33 of the housing 24 by pivoting of the rollers 34 about the pivot axis 41.

The structure for mounting the pressure rollers 34 on the housing 24 for rotation about their common axis 36 and for limited pivotal movement about the pivot axis 41, (best see in FIG. 2) includes an axle 43 having journals projecting from its opposite ends about which journals the pressure rollers 34 are mounted for rotation. The axle 43 includes two cylindrical pivot pins 45 projecting in opposite directions along a common axis 41 transverse of the common axis 36 of the rollers 34 midway between the rollers 34. The pivot pins 45 are received in openings 46 in spaced support portions of the housing 24, which openings 46 are coaxial with and define the pivot axis 41, and the axle 43 can pivot about the pivot axis 41 by rotation of the pivot pins 45 relative to those support portions. The amount of such pivoting of the axle 43 in either direction is limited by contact between the housing 24 and portions of the axle 43 between the pivot pins 45 and the rollers 34.

The pressure application structure also includes fixed parts of the housing portions 26 between the pressure rollers 34 that have generally semi cylindrical arcuate surfaces 39 generally aligned with the surface portions of the pressure rollers 34 that project from the housing 24 when the common axis 36 of the rollers 34 is parallel to a plane along the guide surface 32, which arcuate surfaces 39 provide pressure against, or at least guiding and support for, the portion of the tape being applied that extends between the pressure rollers 34.

One of several alternative means described below are provided for attaching the portions 26 of the housing 24 together. Also provided are means including two opposed semi-cylindrical projections 38 projecting toward each other from the housing portions 26 and having peripheral surfaces closely received along the inner surface of the core 18 for journaling the roll 16 of tape for free rotation and axial movement between the portions 26 of the housing 24 with the tape contact part 28 of the inner surface for each housing portion 26 along a different one of the side surfaces 22 of the roll 16 of tape. Means are provided for defining a path for the length of tape 12 from the periphery of the roll 16 of tape to the periphery of the pressure application structure with the edges of the tape at or closely adjacent the intersections of the first and second planes 29 and 30 and with the adhesive on the tape 12 on the side of the backing opposite the pressure application structure including its rollers 34 so that the dispenser 10 can be manually positioned with the guide part 31 of the outer surface of either portion 26 of the housing 24 against the surface 15 to be treated and moved along the surfaces 15 and 13 to be treated and protected to accurately apply and press the tape 12 from the roll 16 of tape on the surface 13 to be protected with the peripheral surfaces 35 of the pressure rollers 34 and with the edge 14 of the tape 12 at a predetermined relationship with respect to the juncture between the surface to be protected 13 and the surface 15 to be treated.

The generally cylindrical peripheral surface 35 of each pressure roller 34 is slightly tapered away from its outer edge 37 (e.g., by about 4.5 degrees) so that its peripheral surface 35 will be disposed at an angle in the range of about 80 to 90 degrees (and preferably about 89.5 degrees) with respect to the adjacent second plane 30 when the common axis 36 of the rollers 34 is pivoted its maximum amount to move that roller 34 toward the top side 33 of the housing 24. This angle helps to insure that the peripheral surface 35 of the roller 34 can apply firm pressure on the backing of tape being applied by the device 10 along the width of the roller 34 with a higher pressure being applied at and adjacent its outer edge 37.

Figure 2:
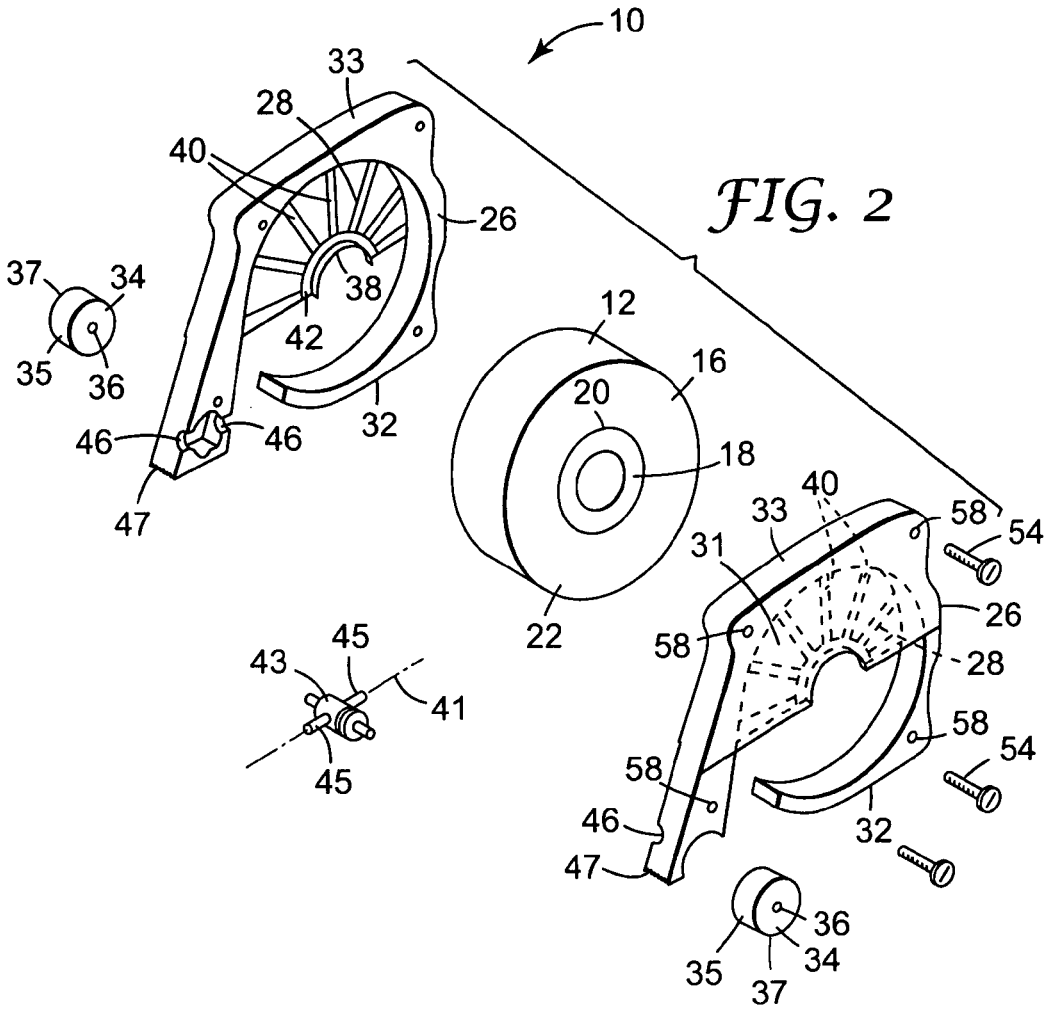
FIG. 2 is an exploded perspective view of the device of FIG. 1.
Figure 5:
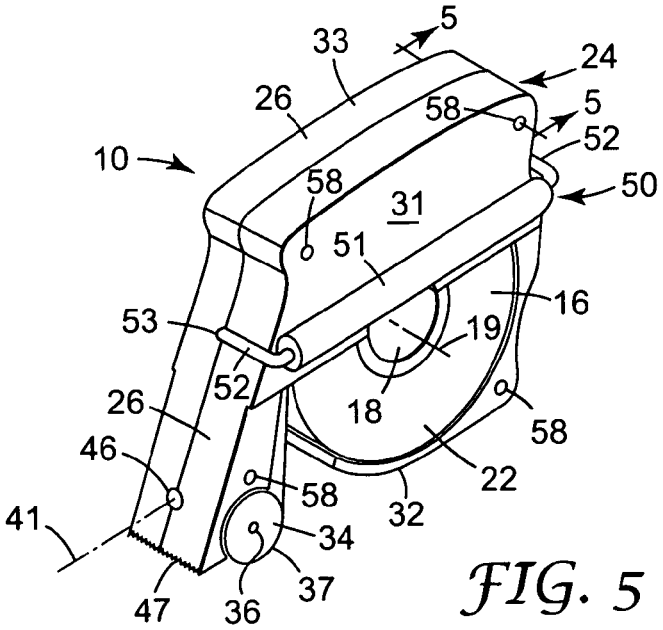
FIG. 5 is a perspective view of the device of FIG. 1 which has been modified by adding a handle.
Figure 3:
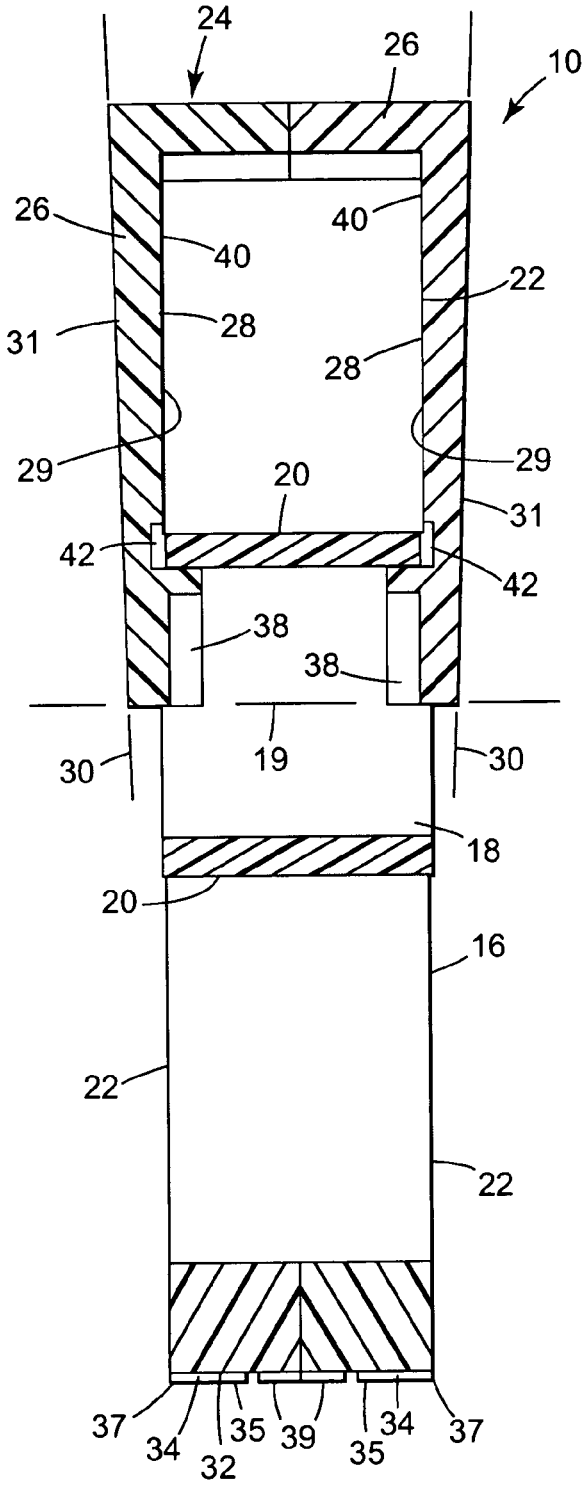
FIG. 3 is an enlarged sectional view of the device of FIG. 1 taken approximately along line 3—3 of FIG. 1.

As is seen in FIG. 2, the tape contact part 28 of the inner surface for each housing portion 26 along a different one of the side surfaces 22 of the roll 16 of tape can be defined by ridges 40 extending radially from the axis 19 of the roll 16 of tape. Those ridges 40 restrict adhesion to the ridges 40 of adhesive that sometimes migrates to the side surfaces 22 of the roll 16 of tape.

Also, each housing portion 26 has adjacent the end of the core 18 a circular recess 42 from the tape contact part 28 of the inner surface along the side surface 22 of the roll 16 of tape to insure that those parts 28 of the inner surfaces for the housing portions 26 can contact the side surfaces 22 of the roll 16 of tape despite projections of the core 18 from the side surfaces 22 of the roll 16 of tape (i.e., cores typically project from the side surfaces of a roll of tape and can project as much as 0.050 inch or 0.13 cm from those side surfaces).

Each of the pressure rollers can, optionally, have an end surface 44 projecting in the range of about 0.010 to 0.020 inch beyond the second plane 30 when the common axis 36 of the rollers 34 is pivoted its maximum amount to move that roller 34 toward the top side 33 of the housing 24. This end surface 44 can contact the surface 15 to be treated as the guide part 31 of the outer surface of one of the housing portions 26 is slid along it, and can space the edge 14 of the tape 12 being applied to the surface 13 to be protected a short distance (about 0.010 to 0.020 inch) along that surface 13 to be protected from the surface 15 to be treated. This space insures that the surface 15 to be treated is fully treated (e.g., if the surface 15 to be treated is a wall being painted, the edge 14 of the tape 12 is spaced from the wall so that its thickness will not prevent the paint from extending along the wall to the intersection between the wall and the surface 13 to be protected).

The device 10 further includes means for providing a sharp tape cutting edge 47 on the housing 24 adjacent the pressure rollers 34 that is adapted for severing tape 12 applied to a surface to be protected from tape 12 in the device 10 by manual manipulation of the device 10. As illustrated, that edge 47 is provided by a row of teeth of a conventional type for severing masking tape molded into a narrow projecting edge portion of the housing 24 on the side of the pressure rollers 34 opposite the roll 16 of tape. Alternatively, that cutting edge 47 could be formed along the edge of a metal blade (not shown) attached to the housing 24, which metal blade could retain a sharp edge for a longer time than would the polymeric housing 24 as might be desirable if the dispenser 10 is made refillable (i.e., the housing portions 26 can be separated by a user of the device 10 to remove an empty core 18 and/or insert of a new roll 16 of tape and then again closed as described below).

Figure 4:
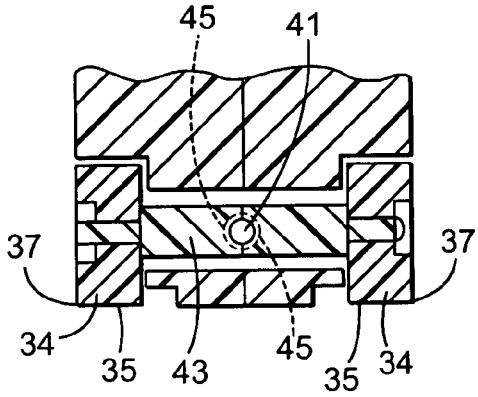
FIG. 4 is an enlarged sectional view of the device of FIG. 1 taken approximately along line 4—4 of FIG. 1.

Also, the device 10 can optionally, as is illustrated in FIG. 4, further include a handle 50 comprising an elongate central portion 51 adapted for manual engagement, and end portions 52 attached to opposite ends of the central portion 51 and projecting in the same direction generally normal to an elongate axis of the central portion 51, which end portions 52 have ends 53 opposite the central portion 51 pivotally attached to the housing 24 at the juncture of the housing portions 26. Such handle shape and attachment afford movement of the handle 50 between positions along the outer surfaces of either of the housing portions 26. The handle 50 can thus be moved to a position at which it can be manually engaged to move the device 10 in a desired direction along a surface 13 to be protected.

The means for attaching the portions 26 of the housing 24 together should provide a reasonably close tolerance (e.g., no greater than about 0.02 inch or 0.05 cm, and preferably no greater than about 0.06 inch or 0.15 cm) between the tape contact parts 28 of the inner surfaces of the housing portions 26 and the side surfaces of the roll 16 of tape when tape is being applied by the device 10 to insure accurate positioning of the tape, while accommodating the wide variance in thickness of different rolls 16 of tape of the same nominal width. The manufacturing tolerance for the thickness of a roll 12 of masking tape is about 0.06 inch or 0.15 cm above or below its nominal width. Thus, the spacing between the tape contact parts 28 of the inner surfaces of the housing portions 26 can be at least 0.06 inch or 0.15 cm above the nominal width of the tape the device 10 is designed to dispense. Means for attaching the portions 26 of the housing 24 together can be manually releasable, and can, as illustrated, comprise a plurality of (e.g., four) spaced releasably engageable fasteners or screws 54 between the housing portions 26 that can be removed to afford separation of the housing portions 26 by a user of the device 10 to remove an empty core 18 and/or to insert a new roll 16 of tape. If the device 10 is intended to be disposable the means for attaching the portions 26 of the housing 24 together could also an adhesive, sonic welding or another means for permanently attaching the housing portions together.

Alternatively, the device 10 could use any of the several means for attaching the portions 26 of the housing together described in U.S. Pat. No. 6,742,562 (the content whereof is incorporated herein by reference) that provide a close tolerance between the tape contact parts 28 of the inner surface of the housing portions 26 and the side surfaces of the roll 16 of tape when tape is being applied by the device 10, while accommodating the wide variance in thickness of different rolls 16 of tape of the same nominal width. The means for attaching the portions 26 of the housing together described in U.S. Pat. No. 6,742,562 are not needed in the device 10, however, because the pattern of pressure applied to the tape being applied by the peripheral surface of the roller 34 along its edge adjacent the surface to be treated will cause the roll 16 of tape to move axially to a position along the inner surface of the housing portion 26 adjacent the surface 15 to be treated to provide the desired accurate placement of that edge of the tape by the device 10.

Figure 6:
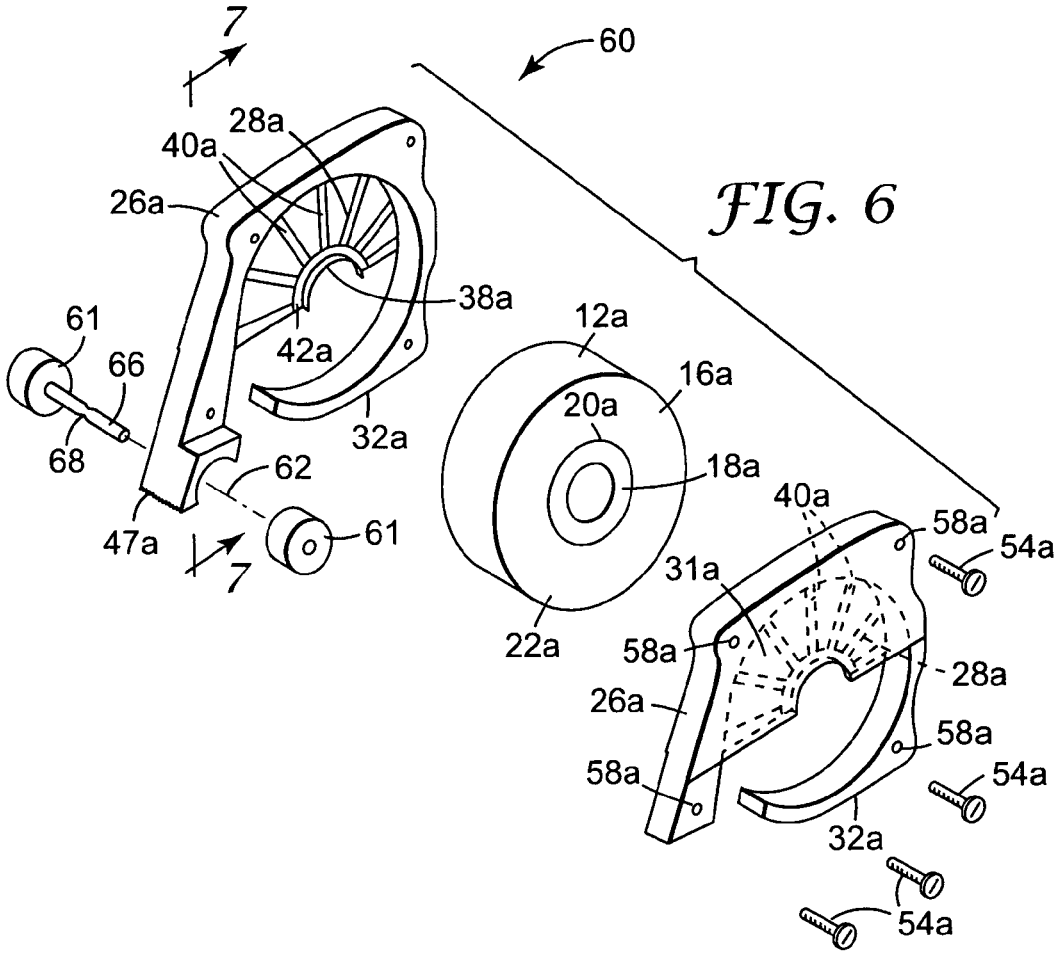
FIG. 6 is an exploded perspective view of a second embodiment of a device according to the present invention.
Figure 7:
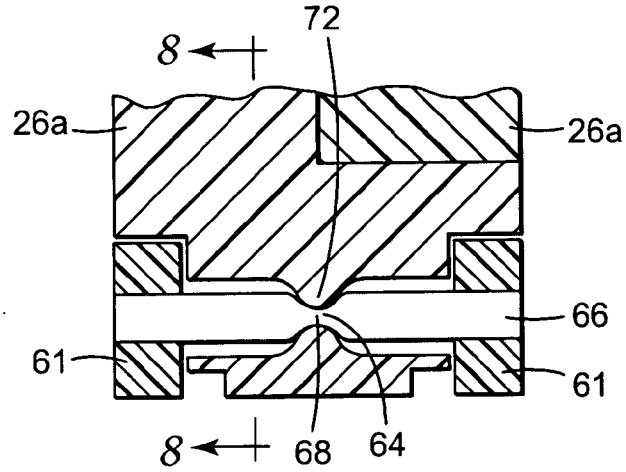
FIG. 7 is an enlarged sectional view of the device of FIG. 6 taken approximately along line 7—7 of FIG. 6.
Figure 8:
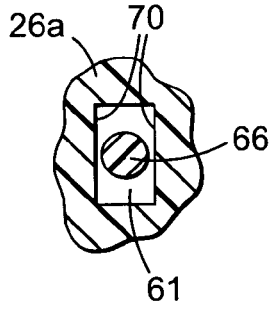
FIG. 8 is a fragmentary sectional view taken approximately along line 8—8 of FIG. 7.

FIGS. 6, 7, and 8 illustrate a second embodiment for a device 60 according to the present invention that includes an alternative structure for mounting two pressure rollers 61 on a housing 24' for rotation about a common axis 62 and for pivotal movement about a pivot axis 64, which alternate structure could be substituted for the structure for mounting he pressure rollers 34 on the housing 24 for rotation about their common axis 36 and for limited pivotal movement about the pivot axis 41 described above. Except for that alternate structure described below, the device 60 and a roll of tape 16*a* in the device 60 have essentially the same structures as the device 10 and the roll of tape 16 described above and have applied to them the same reference numerals to which has been added the suffix "a". In the alternative structure illustrated in FIGS. 6, 7, and 8, the rollers 61 are integrally fixed on the opposite end portions of an axle 66 that extends between the rollers 61. The axle 66 has an annular portion 68 of reduced diameter midway between the rollers 61, which annular portion 68 of reduced diameter has a concave arcuate surface. The rollers 61, the axle 66, and the concave arcuate surface of the annular portion 68 are coaxial about an axis 62. The axle 66 is positioned between closely spaced parallel planar surfaces 70 on portions on one of the portions 26*a* of the housing 24*a*, and that portion 26*a* of the housing 24*a* has a support ridge 72 extending along an axis transverse of the common axis of the rollers 61 midway between the rollers 61, which support ridge 72 has a convex arcuate surface that is received in the portion 68 of reduced diameter on the axle 66. The axle 66 can rotate against and can pivot around the support ridge 72 in the space between the parallel surfaces 70. The parallel surfaces 70 limit the axle 66 and the rollers 61 to pivotal movement in a plane at about a right angle with respect to a plane along the guide surface 32*a*, and the amount of such pivoting in either direction is limited by contact between the housing 24*a* and portions of the axle 66 between the support ridge 72 and the rollers 61.

Figure 9:
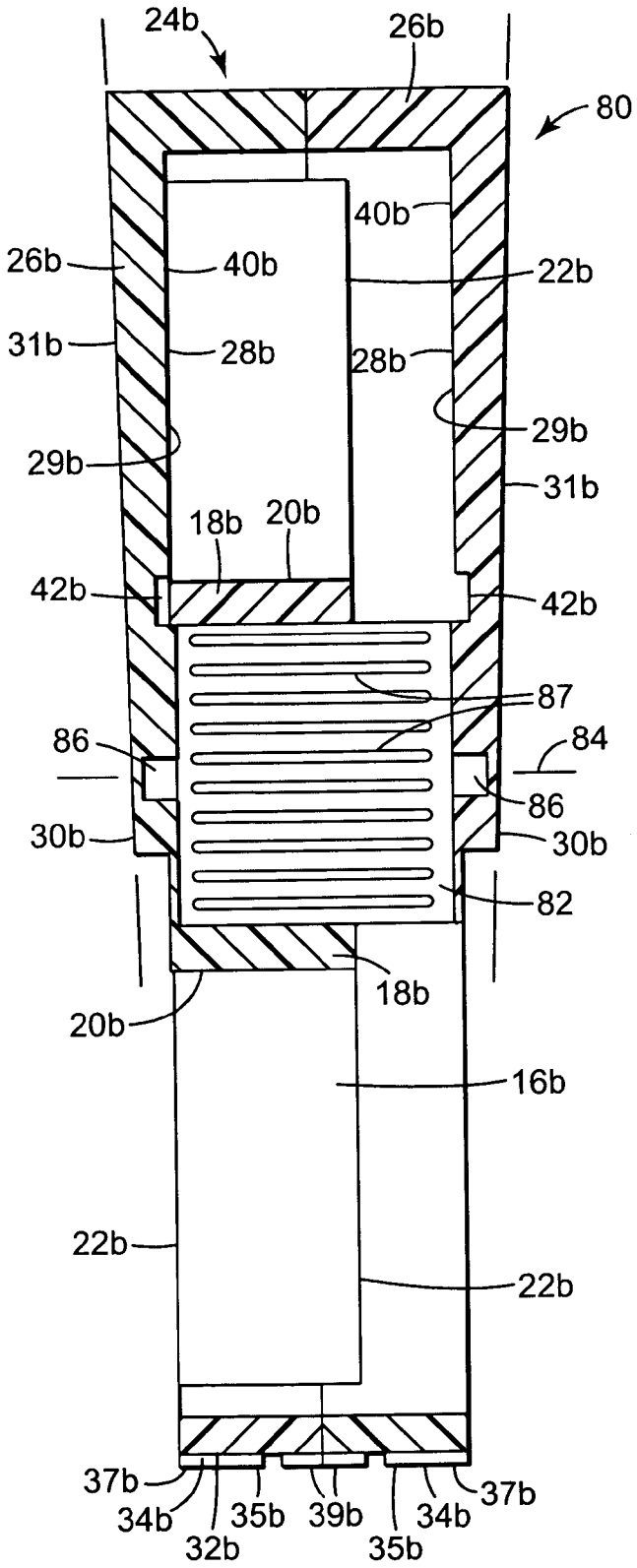
FIG. 9 is an enlarged sectional view of a third embodiment of a device according to the present invention taken along a plane of that device corresponding to the plane of the sectional view of FIG. 3.

FIG. 9 illustrates a third embodiment of a device 80 according to the present invention that includes an alternative means for journaling the roll of tape 16*b* which, like the means for journaling the rolls of tape 16 and 16*a* in the devices 10 and 60, affords free rotation of the roll of tape 16*b*, but unlike those means, does not allow free axial movement of the roll of tape 16*b* between the portions 26*b* of the housing 24*b*. Except for that alternate structure described below, the device 80 and a roll of tape 16*b* in the device 80 could have essentially the same structures as either the device 10 and the roll of tape 16 or the device 60 and the roll of tape 16*a* described above and have applied to them the same reference numerals to which has been added the suffix "b". In the device 80, the means for journaling the roll of tape 16*b* comprises a cylindrical roller 82 having an axis 84, and coaxial trunnions 86 projecting from its opposite ends mounted for rotation in the housing portions 26*b*. The roller 82 has axially extending ridges 87 about its periphery adapted to make frictional engagement with the inner surface of the core 18*b* of the roll of tape 16*b*. A user of the device 80 must manually move the roll of tape 16*b* axially along the periphery of the roller 82 and into contact with the tape contact part 28*b* of the inner surface for the housing portion 26*b* that is being moved along a surface to be treated to apply the tape to a surface to be protected. If desired, openings in the housing portions 26*b* in addition to those illustrated could be provided to provide access to the roll of tape 16*b* to facilitate such manual movement of the roll of tape 16*b*. This modified device provides the advantage that it can be used to apply rolls of tape 16*b* that have an axial width dimension that is significantly less than the dimension between the tape contact parts 28*b* of the inner surfaces for the housing portions 26*b*. Thus, the same dispenser can be used to accurately apply tapes of different widths. For example, if the tape contact parts 28*b* of the inner surfaces for the housing portions 26*b* of the device 80 are spaced at 2.06 inch or 5.23 cm, the device 80 can be used to dispense tape from rolls of tape 16*b* having nominal widths of 2 inch (5 cm) or less such as nominal widths of 1.5, 1, ¾ or ½ inch (3.8, 2.5, 1.9, 1.3 cm).

The present invention has now been described with reference to three embodiments and several modifications thereof. It will be apparent to those skilled in the art that many further changes can be made in the embodiments described above without departing from the scope of the present invention. For example, a device for dispensing tape could be made having a housing that included only one of the novel housing portions 26 described above. Also, the pressure application structures, instead of allowing the rollers 34 or 61 to rotate, could be entirely provided by parts that pivot but do not rotate relative to the housing portions 26. As an example, the rollers 34 could be fixed at the ends of the axle 43, or the axle 66 could be mounted so that it could not rotate by providing a transverse slot on the axle 43 to receive the support ridge 72 rather than an annular portion 68 of reduced diameter. Such a pressure application structure would have arcuate surfaces that are slid along (rather than roll along) the tape being applied to press that tape against the substrate to which it is being applied. Thus, the scope of the present invention should not be limited to the structures and methods described in this application, but only by the structures and method described by the language of the claims and the equivalents thereof.

What is claimed is:

1. A device manually used to apply tape along a surface to be protected with an edge of the tape extending along a juncture between the surface to be protected and a surface to be treated disposed at about a right angle with respect to the surface to be protected, tape being applied by said device from a roll of tape comprising a core having an axis, a cylindrical periphery around said axis, and a length of tape comprising a backing having opposite major surfaces extending between opposite elongate edges and a layer of pressure sensitive adhesive along one of said major surfaces, said length of tape being wound around said periphery with said edges aligned to form side surfaces for the roll of tape, said device including:

a housing adapted to receive the roll of tape, said housing having a guide surface adapted to be slid along the surface to be protected and comprising at least one housing portion having a tape contact part of an inner surface for the housing portion in a first plane, and having in a second plane a guide part of an outer surface for the housing portion adapted to be slid along the surface to be treated and disposed at about a right angle with respect to said guide surface, said first and second planes on said housing portion being disposed relative to each other in a range between being parallel to each other and being disposed at a small angle with respect to each other with said first and second planes intersecting adjacent the intersection of said second plane and a plane along said guide surface;

a pressure application structure having an end portion, said end portion having an arcuate peripheral surface around an axis, and an outer edge;

means mounting the pressure application structure on the housing for a limited predetermined amount of pivotal movement away from a position with the axes of the arcuate peripheral surface at a right angle with respect to the first plane on the housing portion, said pivotal movement moving the end portion of the pressure application structure toward a top side of the housing portion opposite the guide surface, said pivotal movement being about a pivot axis spaced from the end portion, transverse to the axis of the peripheral surface, and in a plane at about a right angle with respect to a plane along the guide surface and said peripheral surface, the arcuate peripheral surface on the end portion of the pressure application structure being disposed at an angle of no greater than 90 degrees with respect to the adjacent second plane and projecting from the housing when the pressure application structure is pivoted to said maximum angle to move the end portion of the pressure application structure toward a top side of the housing portion opposite the guide surface;

means for journaling the roll of tape on the housing with said tape contact part of the inner surface for the housing portion along one of the side surfaces of the roll of tape; and means for defining a path for the length of tape from the periphery of the roll of tape to the periphery of said pressure application structure at said predetermined location with the adhesive on the tape on the side of the backing opposite the pressure application structure so that the dispenser can be manually positioned with the portion of the housing against the surface to be treated and the guide surface along the surface to be protected, and the dispenser can be moved along the surfaces to be treated and protected to accurately apply and press the tape from the roll of tape on the surface to be protected with the peripheral surface of the pressure application structure and with the edge of the tape at a predetermined relationship with respect to the juncture between the surface to be protected and the surface to be treated.

2. A device according to claim 1 wherein pivotal movement of said pressure application structure about said pivot axis is limited to a maximum angle in the range of ½to 4 degrees away from a position with the axis of said arcuate peripheral surface parallel to said plane along said guide surface and said arcuate surface.

3. A device according to claim 2 wherein said first and second planes on said housing portion are at an angle of less than 4 degrees with respect to each other, and the arcuate peripheral surface of the pressure application structure is disposed at an angle in the range of about 80 to 90 degrees with respect to the second plane when the pressure application structure is pivoted to said maximum angle to move said pressure application structure toward the top side of said housing portion.

4. A device according to claim 1 wherein pivotal movement of said pressure application structure about said pivot axis is limited to an angle of about 2 degrees away from a position with the axis of said arcuate peripheral surface parallel to said plane along said guide surface and said arcuate surface.

5. A device according to claim 4 wherein said first and second planes on said housing portion are at an angle of about 2 degrees with respect to each other, and the arcuate peripheral surface of the pressure application structure is generally cylindrical and is disposed at an angle of about 89.5 degrees with respect to the second plane when the pressure application structure is pivoted to said maximum angle to move said pressure application structure toward the top side of said housing portion.

6. A device according to claim 1 wherein said pressure application structure has an end surface projecting in the range of about 0.005 to 0.020 inch or 0.01 to 0.05 centimeter beyond the intersection of said first and second planes when the pressure application structure is pivoted to said maximum angle to move said pressure application structure toward the top side of said housing portion.

7. A device according to claim 1 wherein said pressure application structure comprises a roller having a peripheral surface that is generally cylindrical about said axis providing at least a portion of said cylindrically arcuate peripheral surface, said outer edge is at one end of said peripheral surface, said pressure roller is mounted on the housing for rotation about said axis with a part of the outer edge of the pressure roller at the intersection of said first and second planes, and the generally cylindrical peripheral surface of the pressure roller is disposed at an angle of no greater than 90 degrees with respect to the second plane when the pressure application structure is pivoted to said maximum angle to move said pressure application structure toward the top side of said housing portion.

8. A device according to claim 1 wherein said means for journaling the roll of tape on the housing with said tape contact part of the inner surface for the housing portion along one of the side surfaces of the roll of tape journals the tape for free rotation and free axial movement relative to the housing.

9. A device according to claim 1 wherein said means for journaling the roll of tape on the housing with said tape contact part of the inner surface for the housing portion along one of the side surfaces of the roll of tape journals the tape for free rotation while restricting axial movement of the roll of tape relative to the housing and allowing manual axial movement of the roll of tape relative to the housing.

10. A device that can be manually used to apply tape along a surface to be protected with an edge of the tape extending along a juncture between the surface to be protected and a surface to be treated disposed at about a right angle with respect to the surface to be protected, said device dispensing the tape from a roll of tape comprising a core having an axis, a cylindrical periphery around said axis, and a length of tape comprising a backing having opposite major surfaces extending between opposite elongate edges and a layer of pressure sensitive adhesive along one of said major surfaces, said length of tape being wound around said periphery with said edges aligned to form side surfaces for the roll of tape;

said device comprising:

a housing adapted to receive the roll of tape, said housing having a guide surface adapted to be slid along the surface to be protected and comprising two housing portions, each of said housing portions having a tape contact part of an inner surface for the housing portion in a first plane, and having in a second plane a guide part of an outer surface for the housing portion adapted to be slid along the surface to be treated, said first and second planes on each of said housing portions being disposed relative to each other in a range between being parallel to each other and being disposed at a small angle with respect to each other with said first and second planes intersecting adjacent the intersection of said second plane and a plane along said guide surface;

a pressure application structure having opposite end portions, each of said end portions having an arcuate peripheral surface around an axis, and an outer edge, said pressure application structure being mounted on the housing for a limited predetermined amount of pivotal movement in either direction away from a position with the axes of the arcuate peripheral surfaces at a right angle with respect to the first planes on the housing portions, said pivotal movement being about a pivot axis midway between the end portions, transverse to the axis of the peripheral surfaces, and in a plane at about a right angle with respect to a plane along the guide surface, said arcuate peripheral surface on each end portion of the pressure application structure being disposed at an angle of no greater than 90 degrees with respect to the adjacent second plane and projecting from the housing when the pressure application structure is pivoted to its that maximum angle to move said each end portion of the pressure application structure toward a top side of the housing portion opposite the guide surface;

means for attaching said portions of the housing together;

means for journaling the roll of tape between the portions of the housing with said tape contact part of the inner surface for each housing portion along a different one of the side surfaces of the roll of tape; and means for defining a path for the length of tape from the periphery of the roll of tape to the periphery of said pressure application structure with the adhesive on the tape on the side of the backing opposite the pressure application structure so that the dispenser can be manually positioned with either portion of the housing against the surface to be treated and moved along the surfaces to be treated and protected to accurately apply and press the tape from the roll of tape on the surface to be protected with the peripheral surfaces of the pressure application structure and with the edge of the tape at a predetermined relationship with respect to the juncture between the surface to be protected and the surface to be treated.

11. A device according to claim 10 wherein pivotal movement of said pressure application structure about said pivot axis is limited to a maximum angle in the range of ½ to 4 degrees away from a position with the axis of said arcuate peripheral surface parallel to said plane along said guide surface and said arcuate surfaces.

12. A device according to claim 11 wherein said first and second planes on each of said housing portions are at an angle of less than 4 degrees with respect to each other, and the arcuate peripheral surfaces of the pressure application structure are each disposed at an angle in the range of about 80 to 90 degrees with respect to the adjacent second plane when the pressure application structure is pivoted to said maximum angle to move said each pressure application structure toward the top side of said housing portion.

13. A device according to claim 10 wherein pivotal movement of said pressure application structure about said pivot axis is limited to an angle of about 2 degrees away from a position with the axis of said arcuate peripheral surface parallel to said plane along said guide surface and said arcuate surfaces.

14. A device according to claim 13 wherein said first and second planes on each of said housing portion are at an angle of about 2 degrees with respect to each other, and the arcuate peripheral surfaces of the pressure application structure are each generally cylindrical and disposed at an angle of about 89.5 degrees with respect to the adjacent second plane when the pressure application structure is pivoted to said maximum angle to move said each pressure application structure toward the top side of said housing portion.

15. A device according to claim 10 wherein said pressure application structure includes an axle having opposite ends, a generally cylindrical roller mounted for rotation relative to said axle at each of the opposite ends of said axle to provide said arcuate peripheral surfaces, said axle has a center between said rollers, and said device includes means for mounting the center of the axle on the housing for pivotal motion of the axle about said pivot axis.

16. A device according to claim 10 wherein said pressure application structure includes an axle having an axis and opposite ends, a generally cylindrical roller coaxially fixed on said axle at each of the opposite ends of said axle to provide said arcuate peripheral surfaces, said axle has a center between said rollers, and said device includes means for mounting the center of the axle on the housing for pivotal motion of the axle about said pivot axis and for rotation of said axle and rollers about the axis of said axle and rollers.

17. A device according to claim 10 wherein said tape contact part of the inner surface for each housing portion along a different one of the side surfaces of the roll of tape is defined by ridges extending radially from the axis of said roll of tape, and each housing portion has a recess from said tape contact part of the inner surface for each housing portion adjacent said core.

18. A device according to claim 10 wherein each of said pressure application structures has an end surface projecting in the range of about 0.005 to 0.020 inch or 0.01 to 0.05 centimeter beyond the intersection of the adjacent first and second planes when the pressure application structure is pivoted to said maximum angle to move said each pressure application structure toward the top side of said housing portion.

19. A device according to claim 10 wherein said means for journaling the roll of tape between the portions of the housing with said tape contact part of the inner surface for each housing portion along a different one of the side surfaces of the roll of tape journals the tape for free rotation and axial movement relative to the housing.

20. A device according to claim 10 wherein said means for journaling the roll of tape between the portions of the housing with said tape contact part of the inner surface for each housing portion along a different one of the side surfaces of the roll of tape journals the tape for free rotation while restricting axial movement of the roll of tape relative to the housing and affording manual axial movement of the roll of tape along said means for journaling.

* * * * *